US006860771B2

(12) United States Patent
Mashiko

(10) Patent No.: US 6,860,771 B2
(45) Date of Patent: Mar. 1, 2005

(54) INDUCTION SYSTEM FOR MARINE ENGINE

(75) Inventor: Tetsuya Mashiko, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 92 days.

(21) Appl. No.: 10/113,335

(22) Filed: Mar. 29, 2002

(65) Prior Publication Data

US 2003/0003823 A1 Jan. 2, 2003

(30) Foreign Application Priority Data

Jun. 27, 2001 (JP) ..... 2001-194557

(51) Int. Cl.[7] ..... B63H 21/10
(52) U.S. Cl. ..... 440/88 A
(58) Field of Search ..... 440/88 A, 88 J, 440/89 R

(56) References Cited

U.S. PATENT DOCUMENTS

| | | | | | |
|---|---|---|---|---|---|
| 3,992,173 | A | * | 11/1976 | Wharton et al. | 55/501 |
| 4,077,739 | A | * | 3/1978 | Heilenbach | 415/121.2 |
| 4,313,741 | A | * | 2/1982 | Masuda et al. | 96/78 |
| 4,647,373 | A | * | 3/1987 | Tokar et al. | 210/232 |
| 4,758,460 | A | * | 7/1988 | Spicer et al. | 428/159 |
| 4,821,685 | A | | 4/1989 | Matsushima et al. | |
| 4,887,692 | A | * | 12/1989 | Outani et al. | 181/235 |
| 5,088,454 | A | | 2/1992 | Washizu et al. | |
| 5,417,195 | A | | 5/1995 | Tachikawa et al. | |
| 5,647,314 | A | | 7/1997 | Matsumura et al. | |
| 5,723,828 | A | | 3/1998 | Nakagawa | |
| 5,735,229 | A | | 4/1998 | House et al. | |
| 5,873,755 | A | * | 2/1999 | Takahashi et al. | 440/77 |
| 5,957,072 | A | | 9/1999 | Hattori | |
| 5,979,598 | A | | 11/1999 | Wolf et al. | |
| 6,015,321 | A | * | 1/2000 | Ozawa et al. | 440/88 R |
| 6,019,648 | A | | 2/2000 | Lecours et al. | |
| 6,139,381 | A | | 10/2000 | Suzuki et al. | |
| 6,398,602 | B2 | * | 6/2002 | Watanabe | 440/88 R |

FOREIGN PATENT DOCUMENTS

| | | |
|---|---|---|
| JP | 402215925 A | 8/1990 |
| JP | 402241966 A | 9/1990 |

* cited by examiner

*Primary Examiner*—Jesus D. Sotelo
(74) *Attorney, Agent, or Firm*—Knobbe, Martens, Olson & Bear, LLP

(57) ABSTRACT

An induction system for a marine engine is provided. The induction system includes at least one baffle positioned between an intake chamber and a combustion chamber of the engine. The baffle retards intake blow back, thereby reducing noise generated by the engine. The noise reduction protects sensors within the engine compartment from sonic energy damage.

26 Claims, 9 Drawing Sheets

INDUCTION SYSTEM FOR MARINE ENGINE

RELATED APPLICATION

This application claims priority to Japanese Patent Application No. 2001-194557, filed on Jun. 27, 2001, the entire contents of which are hereby incorporated by reference.

BACKGROUND OF THE INVENTION

1. Field of the Invention

The present invention relates to a marine engine. More particularly, preferred embodiments provide an improved air induction system for a marine engine that reduces noise.

2. Description of the Related Art

Personal watercraft are designed to be relatively small and maneuverable, and are usually capable of carrying one, to three riders. These craft commonly include a relatively small hull that defines a rider's area above an engine compartment. The rider's area normally includes a seat.

The engine compartment contains an internal combustion engine that powers a jet propulsion unit. The jet propulsion unit, which includes an impeller, is positioned within a tunnel formed on an underside of the hull behind the engine compartment. A shaft, which is driven by the engine, usually extends between the engine and the jet propulsion device through a bulkhead of the hull tunnel.

The engine includes an air induction system for delivering air into one or more combustion chambers. The engine also includes an exhaust system for expelling exhaust gases from the combustion chambers to the body of water in which the watercraft operates. Where four-cycle engines are used, air enters the combustion chambers through intake valves, and exhaust gases exit the combustion chambers through exhaust valves.

In some four-cycle engines, the valve drive is configured such that the intake valves begin to open just before the end of the exhaust stroke, i.e., just before the piston reaches top dead center. As a result, a small amount of exhaust gas is pushed through the intake valves. This phenomenon is commonly referred to as intake blow back.

SUMMARY OF THE INVENTION

One aspect of the present invention includes the realization that intake blow back in some engines creates a noise that is bothersome to the rider(s) and to other people in the vicinity of the watercraft. Further, it has been found that the noise created by the induction blow back can be audible through the induction systems of engines that have an air filter.

Another aspect of the invention includes the realization that induction blow back in some engines is associated with sonic waves that can cause damage to sensors, that are disposed in the vicinity of induction components. For example, but without limitation, the sonic energy associated with induction blow back can damage pressure sensors that are disposed in a plenum chamber of an induction system.

The preferred embodiments of the induction system for marine engine have several features, no single one of which is solely responsible for their desirable attributes. Without limiting the scope of this induction system as expressed by the claims that follow, its more prominent features will now be discussed briefly. After considering this discussion, and particularly after reading the section entitled "Detailed Description of the Preferred Embodiments," one will understand how the features of the preferred embodiments provide advantages, which include reduced noise and decreased risk of harm to sensors from sonic energy.

A preferred embodiment of the present induction system comprises a watercraft including a hull and an internal combustion engine. The hull defines an engine compartment, and the engine is disposed within the engine compartment. The engine comprises an engine body defining a combustion chamber, and an air induction system including an air intake chamber configured to draw in ambient air. The engine further comprises at least one throttle body configured to draw air from the air intake chamber toward the combustion chamber, and at least one intake valve configured to selectively provide fluid communication between the throttle body and the combustion chamber. At least one baffle is disposed between the air intake box and the at least one throttle body. The baffle is configured to retard blow back of exhaust gases from the combustion chamber through the at least one intake valve.

Another preferred embodiment of the present induction system comprises a watercraft including a hull and an internal combustion engine. The hull defines an engine compartment, and the engine is disposed within the engine compartment. The engine includes an engine body defining at least one combustion chamber, and an air induction system. The air induction system includes an air intake chamber having an inlet. A filter is disposed in the air chamber and is configured to filter the air passing into the air chamber from the inlet. The air induction system further includes at least one throttle body having an inlet end communicating with the air intake chamber, and at least one intake valve configured to selectively provide fluid communication between the throttle body and the combustion chamber. The air induction system further includes means for attenuating sonic energy associated with blow back of exhaust gases passing from the combustion chamber through the at least one intake valve into the air chamber.

Another preferred embodiment of the present induction system comprises a four-cycle internal combustion engine. The engine comprises an engine body defining at least one combustion chamber, an air intake chamber, and an induction passage. The induction passage has an inlet end disposed in an interior of the air intake chamber, and the induction passage extends from the inlet end to the combustion chamber. A baffle is disposed at the inlet end of the induction passage.

Another preferred embodiment of the present induction system comprises a baffle. The baffle comprises at least one triangular aperture. A diameter of a circle inscribed within the aperture is approximately 1 to 2 millimeters.

Another preferred embodiment of the present induction system comprises a baffle. The baffle comprises a first layer of perforated material, a second layer of perforated material overlapping the first layer, and a gap between the first layer and the second layer.

Another preferred embodiment of the present induction system comprises a baffle. The baffle comprises at least a first ribbon wrapped substantially in the shape of a circle, at least a second ribbon wrapped around the first ribbon, and at least a first crimped ribbon sandwiched between the first ribbon and the second ribbon.

BRIEF DESCRIPTION OF THE DRAWINGS

The preferred embodiments of the induction system for personal watercraft, illustrating its features, will now be discussed in detail. The illustrated embodiments depict the novel and non-obvious induction system shown in the accompanying drawings, which are for illustrative purposes only. These drawings include the following figures, in which like numerals indicate like parts.

DETAILED DESCRIPTION OF THE PREFERRED EMBODIMENTS

With reference to FIGS. 1–4, the following describes an overall configuration of a personal watercraft 10. The watercraft 10 is powered by an internal combustion engine 12, which operates on a four-stroke cycle combustion principle. An arrow F, present in several of the figures, indicates the watercraft's forward direction of travel.

Figure 1:
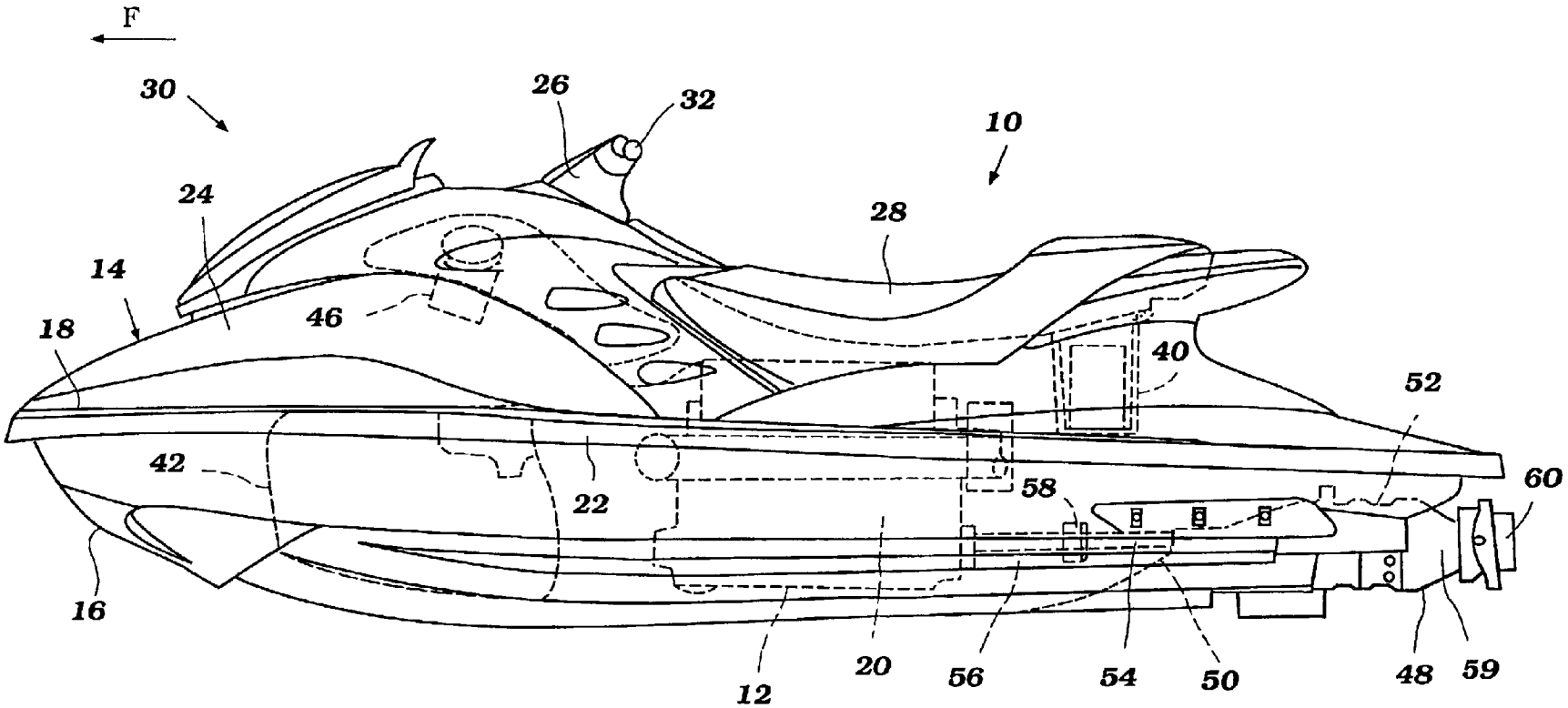
FIG. 1 is a left side elevational view of a personal watercraft of a type powered by a marine engine configured in accordance with a preferred embodiment of the present invention.
Figure 2:
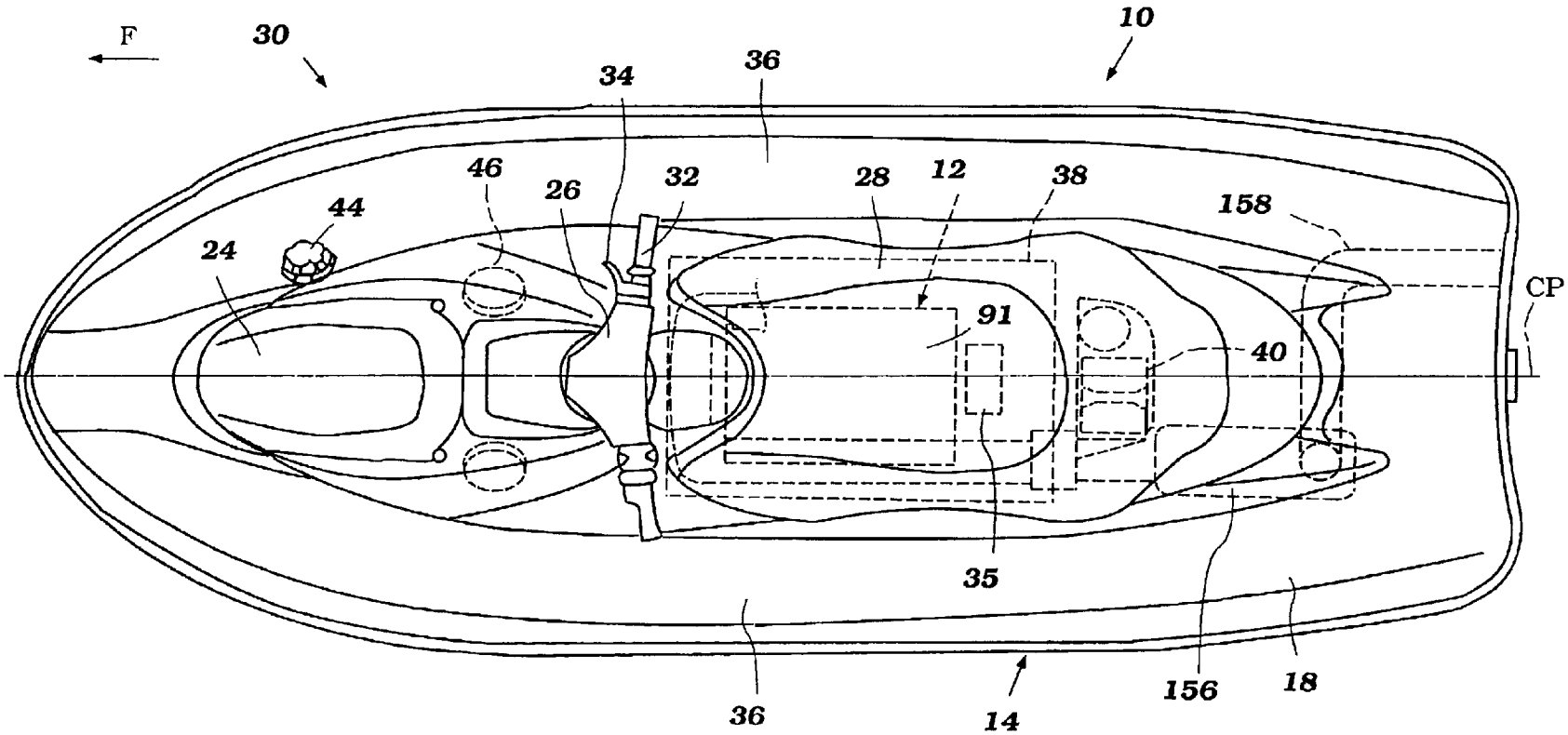
FIG. 2 is a top plan view of the watercraft of FIG. 1.

Referring to FIGS. 1 and 2, the personal watercraft 10 includes a hull 14 formed with a lower hull section 16 and an upper hull section or deck 18. Both hull sections 16, 18 may be constructed of, for example, a molded fiberglass-reinforced resin or a sheet molding compound. The hull sections 16, 18 may, however, be constructed from a variety of other materials selected to make the watercraft 10 lightweight and buoyant. The lower hull section 16 and the upper hull section 18 are coupled together and define an internal cavity 20 (FIG. 1). A bond flange 22 defines an intersection of the lower and upper hull sections 16, 18 and defines part of gunwales that extends partially along the sides of the watercraft 10.

A center plane CP (FIG. 2) extends generally vertically from bow to stern along the hull 14. Along the center plane CP, the upper hull section 18 includes a hatch cover 24, a control mast 26 and a seat 28 arranged from fore to aft. In the illustrated embodiment, a bow portion 30 of the upper hull section 18 slopes upwardly (FIG. 1). An opening (not shown) in the bow portion 30 provides access to the internal cavity 20. The hatch cover 24 is detachably affixed (e.g., hinged) to the bow portion 30 so as to cover the opening.

The control mast 26 extends upwardly and supports a handle bar 32. Primarily, the handle bar 32 controls the direction of travel of the watercraft 10. Grips at either end of the bar 32 aid the rider in controlling the direction of travel, and in maintaining his or her balance upon the watercraft 10. The handle bar 32 also carries other control units such as, for example, a throttle lever 34 that controls running conditions of the engine 12.

The seat 28 extends along the center plane CP to the rear of the bow portion 30. The seat 28 also generally defines a rider's area. The seat 28 has a saddle shape, enabling a rider to sit on the seat 28 in a straddle-type fashion. Foot areas 36 (FIG. 2) are defined on both sides of the seat 28 on the top surface of the upper hull section 18. The foot areas 36 are preferably generally flat.

The seat 28 comprises a cushion detachably supported, at least in principal part, by the upper hull section 18. An opening 38 (FIG. 2) under the seat 28 allows access to the internal cavity 20 when the seat 28 is removed. In the illustrated embodiment, the upper hull section 18 also defines a storage box 40 under the seat 28.

A fuel tank 42 (FIG. 1) occupies a portion of the cavity 20 under the bow portion 30 of the upper hull section 18. A duct (not shown) connects the fuel tank 42 to a fuel inlet port positioned at a top surface of the upper hull section 18. A cap 44 (FIG. 2) seals the fuel inlet port. Optionally, the cap 44 can be positioned under the hatch cover 24.

The configurations of the preferred embodiments of the engine 12 have particular utility in combination with a personal watercraft, such as the personal watercraft 10. Thus, the following describes preferred embodiments of the engine 12 in the context of the personal watercraft 10. These engine configurations, however, can be applied to other types of vehicles as well, such as, for example, small jet boats, off road vehicles or automobiles.

The engine 12 is disposed within an engine compartment within the cavity 20. The engine compartment is preferably located under the seat 28, but other locations are also possible (e.g., beneath the control mast 26 or in the bow 30). The rider thus accesses the engine 12 in the illustrated embodiment through the access opening 38 (FIG. 2) by detaching the seat 28.

The engine compartment 20 is preferably substantially sealed so as to prevent water from entering, which could damage the engine 12 or other components. However, a pair of air ducts or ventilation ducts 46 ventilate the engine compartment. The ventilation ducts 46 are provided on both sides of the bow 30, as shown in FIG. 2. The watercraft 10 may also include additional air ducts (not shown) in a rear area of the internal cavity 20. Ambient air enters the internal cavity 20 through the ducts 46, and travels to the engine 12 where it is used in the combustion reaction that powers the watercraft 10, as described below.

Figure 3:
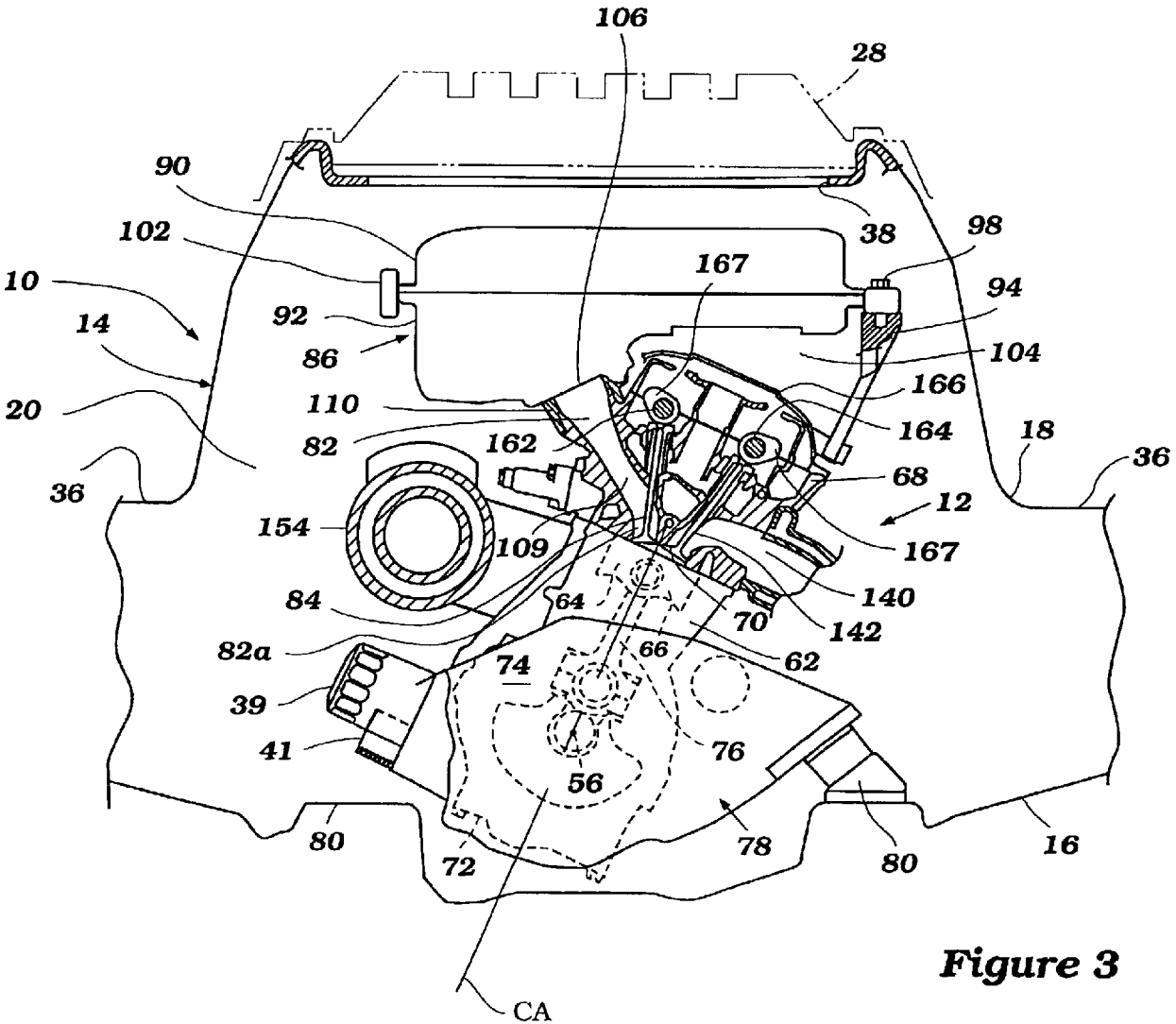
FIG. 3 is a schematic and partial cross-sectional rear view of the watercraft and engine of FIG. 1, including an air intake box, a schematic profile of a hull of the watercraft, and an opening of an engine compartment of the hull.
Figure 4:
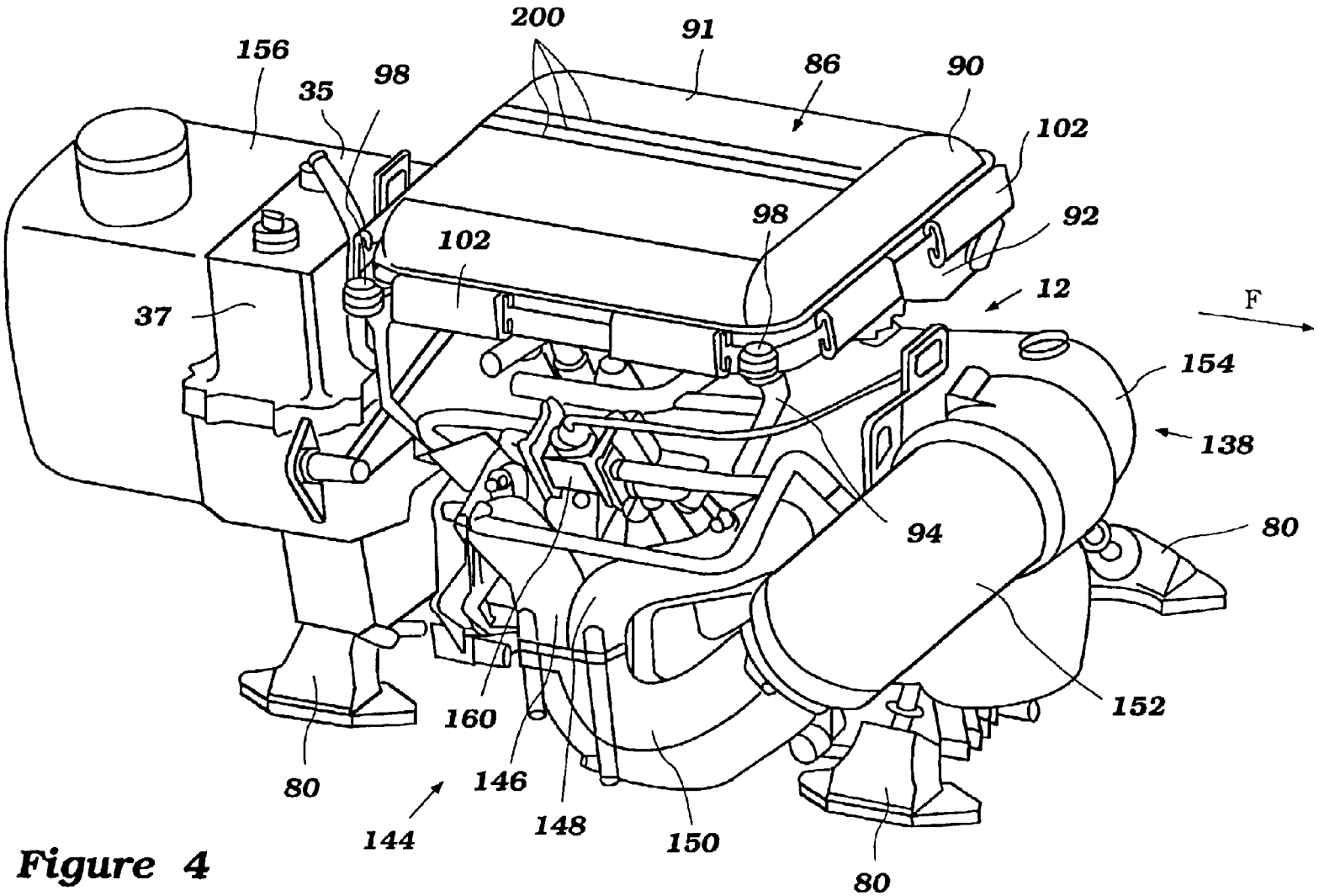
FIG. 4 is a front, top, and starboard side perspective view of the engine of FIG. 3.
Figure 5:
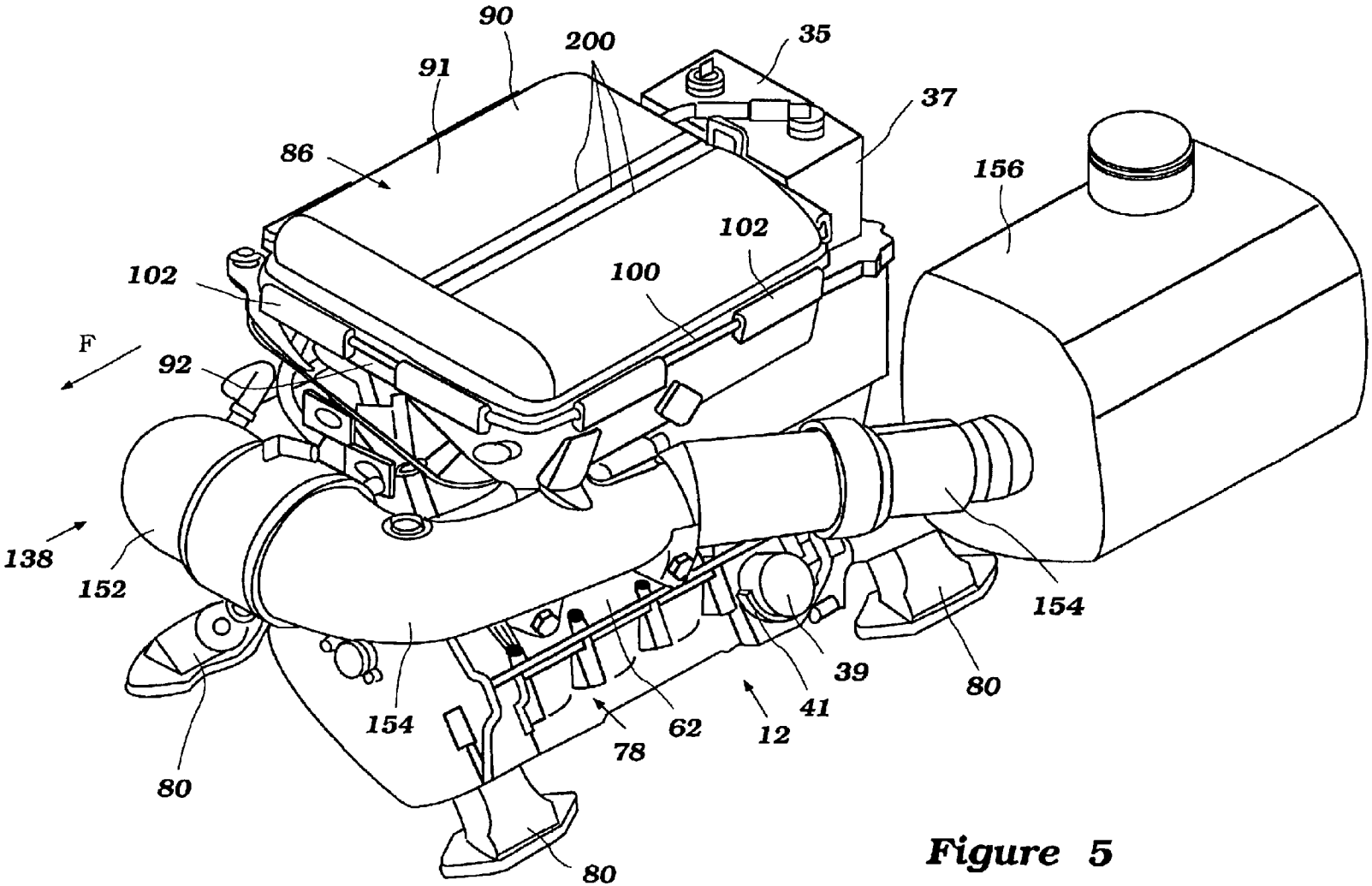
FIG. 5 is a front, top, and port side perspective view of the engine of FIG. 3.

With reference to FIGS. 3–5, the engine 12 includes a cylinder block 62. The cylinder block 62 defines four cylinder bores 64 which are spaced from each other in a fore to aft direction. The engine 12 is thus described as an L4 (in-line four cylinder) type. The illustrated engine 12, however, merely exemplifies one type of engine that may include preferred embodiments of the present induction system. Engines having other number of cylinders, having other cylinder arrangements, other cylinder orientations (e.g., upright cylinder banks, V-type, and W-type) and operating on other combustion principles (e.g., crankcase compression two-stroke, diesel, and rotary) are all practicable.

Each cylinder bore 64 has a center axis CA (FIG. 3) that is oriented at an angle relative to the center plane CP to shorten the height of the engine 12. All of the center axes CA in the illustrated embodiment are inclined at the same angle.

Pistons 66 reciprocate within the cylinder bores 64. A cylinder head 68 is affixed to the upper end of the cylinder block 62. The cylinder head 68 closes the upper ends of the cylinder bores 64 and defines combustion chambers 70 along with the cylinder bores 64 and the pistons 66.

A crankcase member 72 is affixed to the lower end of the cylinder block 62. The crankcase member 72 closes the respective lower ends of the cylinder bores 64 and defines a crankcase chamber 74. A crankshaft 56 is rotatably connected to the pistons 66 through connecting rods 76 and is journaled with the crankcase chamber 74. That is, the connecting rods 76 are rotatably coupled with the pistons 66 and with the crankshaft 56.

The cylinder block 62, the cylinder head 68, and the crankcase 72 together define an engine body 78. The engine body 78 is preferably made of an aluminum based alloy. In the illustrated embodiment, the engine body 78 is oriented in the engine compartment 20 so as to position the crankshaft 56 generally parallel to the central plane CP. Other orientations of the engine body, of course, are also possible (e.g., with a transverse or vertical crankshaft).

Engine mounts 80 extend from both sides of the engine body 78. In FIG. 3 the port side engine mounts 80 are omitted to provide an unobstructed view of the oil filter assembly. The engine mounts 80 preferably include resilient portions made of, for example, a rubber material to attenuate vibrations from the engine 12. The engine 12 is preferably mounted on a hull liner that forms a part of the lower hull section 16.

The engine 12 is lubricated with oil housed in an oil tank 37 (FIGS. 4 and 5) mounted aft of the engine 12. Oil from the tank 37 circulates throughout the engine 12 when the engine 12 is operating. A circulation path of the oil passes through an oil filter 39 (FIGS. 3 & 5) that is mounted to a side of the engine 12. The oil filter 39 removes contaminants from the oil that could harm the engine 12. An oil dish 41 mounted to the engine 12 just beneath the oil filter 39 captures dripping oil when the oil filter 39 is removed from the engine 12.

The engine 12 preferably includes an air induction system configured to guide air to the engine body 78 and thereby into the combustion chambers 70. In the illustrated embodiment, the air induction system includes air intake ports 82, 82*a* (FIG. 3) defined in the cylinder head 68. At least two air intake ports 82, 82*a* communicate with each combustion chamber 70. A first air intake port 82 is located in a first portion of the cylinder head 68 remote from the combustion chamber 70. A second air intake port 82*a* is located in a second portion of the cylinder head 68 adjacent the entrance to the combustion chamber 70. Depending upon the engine configuration, the second air intake ports 82*a* may branch into multiple ports 82*a*. Intake valves 84 selectively open and close the intake ports 82*a*, thereby selectively connecting and disconnecting the intake ports 82, 82*a* with the combustion chambers 70.

The air induction system also includes an air intake box 86 (FIGS. 3–5), which defines a plenum chamber 88 (FIG. 7) within. The air intake box 86 smoothes intake air and acts as an intake silencer. The intake box 86 in the illustrated embodiment has a generally rectangular shape in top plan view. The intake box could, of course, embody other shapes, but preferably the plenum chamber is as large as possible within the available space in the engine compartment 20. In the illustrated embodiment, a space is defined between the top of the engine 12 and the bottom of the seat 28 due to the inclined orientation of the engine 12. The shape of the intake box 86 conforms to this space.

With reference to FIGS. 3–7, the intake box 86 comprises an upper chamber member 90 and a lower chamber member 92. The upper and lower chamber members 90, 92 preferably are made of plastic or synthetic resin, although they can be made of metal or other material. Additionally, the intake box 86 can be formed by a different number of members and/or can have a different assembly orientation (e.g., side-by-side).

Figure 6:
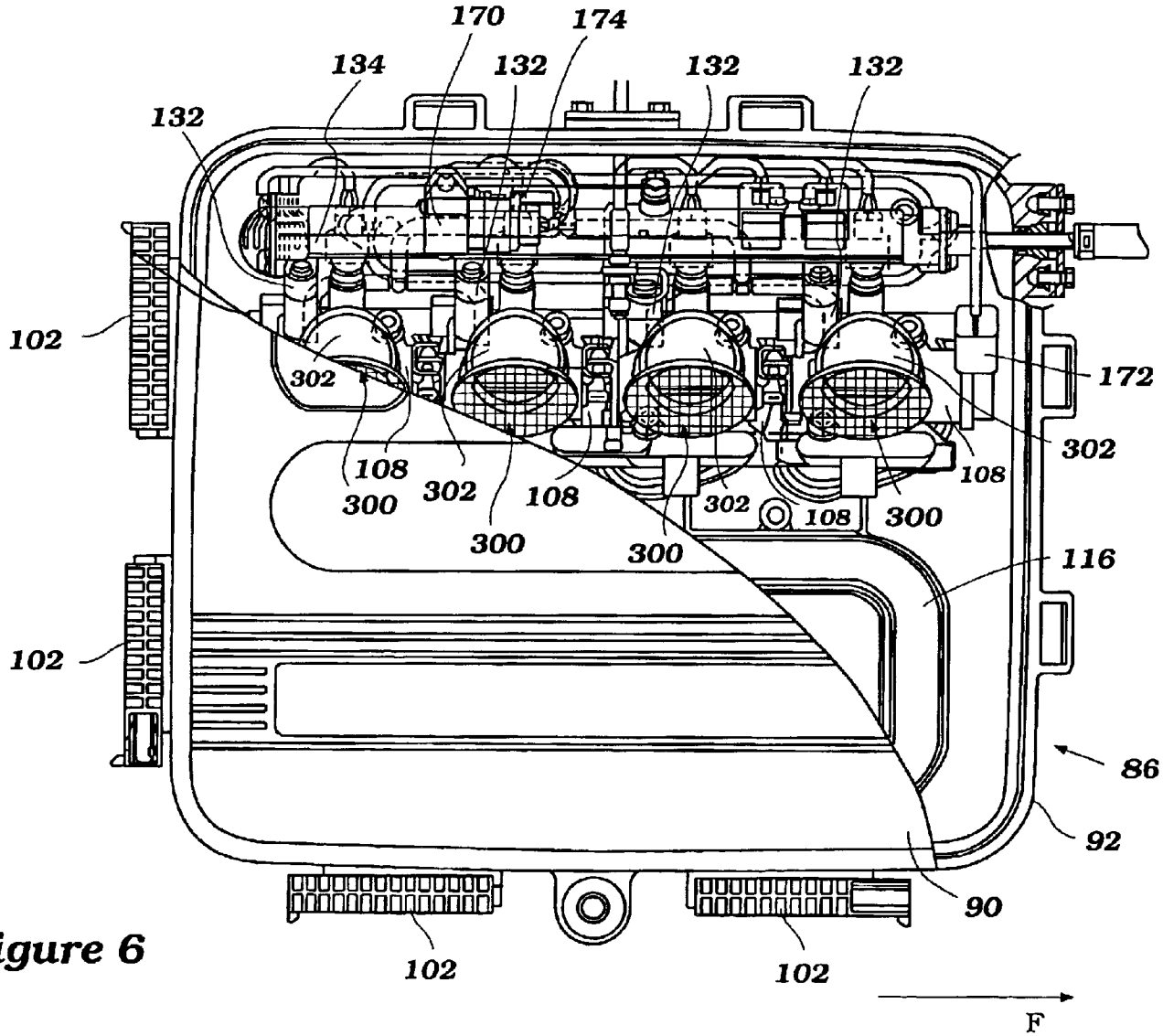
FIG. 6 is a top plan view of the intake box of FIG. 3 with a partially cutaway upper chamber member, exposing a plurality of inlet members.
Figure 7:
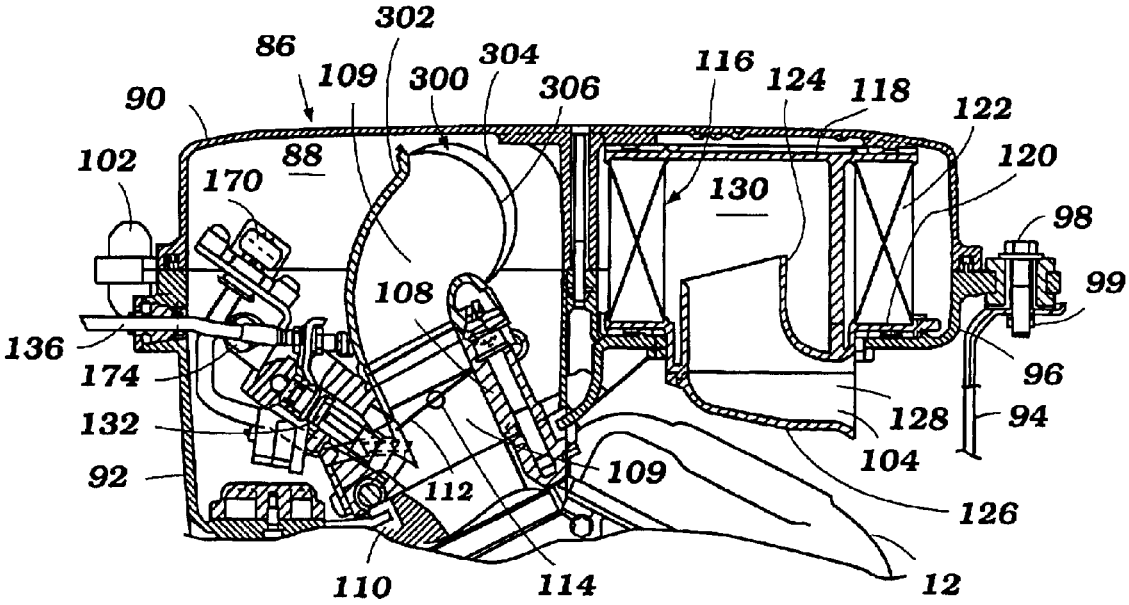
FIG. 7 is a sectional view of the air intake box of FIG. 3, as viewed from its front side, illustrating one of the inlet members shown in FIG. 6.

The intake box 86 houses various sensors that monitor operating conditions of the engine 12. For example, as shown in FIGS. 6 and 7, the intake box may house an intake pressure sensor 170 (e.g., configured to detect vacuum), a throttle position sensor 172 and an intake temperature sensor 174. Sonic energy generated by intake blow back can damage these sensors 170, 172, 174 and other similar sensors. The present induction system, described in detail below, attenuates the sonic energy associated with intake blow back and thus protects these sensors.

With reference to FIG. 3, the lower chamber member 92 is preferably coupled with the engine body 78. In the illustrated embodiment, a plurality of stays 94 (FIGS. 3, 4 and 7) extend upwardly from the engine body 78. A flange portion 96 (FIG. 7) of the lower chamber member 92 extends generally horizontally. Several fastening members, for example, bolts 98 and nuts 99, connect the flange portion 96 to respective top surfaces of the stays 94.

The upper chamber member 90 has a flange portion 100 (FIG. 5) that abuts the flange portion 96 of the lower chamber member 92. Several coupling or fastening members 102 (FIGS. 3–7), which are generally configured as a shape of the letter "C" in section, preferably engage both the flange portions 96, 100 so as to couple the upper chamber member 90 with the lower chamber member 92.

With reference to FIG. 3, the lower chamber member 92 defines an inlet opening 104 and, preferably, four outlet apertures 106. Four throttle bodies 108 (FIG. 7) extend through the apertures 106 and preferably are fixed to the lower chamber member 92. Respective bottom ends of the throttle bodies 108 are coupled with the associated intake ports 82. Preferably, the outlets of bottom ends of the throttle bodies 108 are spaced from the apertures 106. Thus, the lower chamber member 92 is spaced from the engine 12, thereby attenuating heat transfer from the engine body 78 to the intake box 86.

With reference to FIGS. 3 and 7, the throttle bodies 108 slant toward the port side of the watercraft 10, away from the center axis CA of the cylinder bores 64. A sleeve 10 extends between the lower chamber member 92 and the cylinder head 68 so as to generally surround a portion of the throttle bodies 108. Respective inlets of the throttle bodies 108, in turn, open upwardly within the plenum chamber 88. Air in the plenum chamber 88 is thus drawn to the combustion chambers 70 when negative pressure is generated in the combustion chambers 70. Negative pressure is generated when the pistons 66 move toward the bottom dead center from the top dead center. The air travels through an inlet passage 109, which in part comprises the throttle bodies 108 and the intake ports 82, 82*a*.

Each throttle body 108 includes a throttle valve 112 (FIG. 7). A throttle valve shaft 114, journaled for pivotal movement, links the throttle valves 112. Pivotal movement of the throttle valve shaft 114 is controlled by the throttle lever 34 on the handle bar 32 (FIG. 2) through a control cable that is connected to the throttle valve shaft 114. The rider can thus control the opening and closing of the throttle valves 112 by operating the throttle lever 32. The degree to which the throttle valves 112 are open determines the amount of air that passes through the inlet passages 109 and into the respective combustion chambers 70. The amount of air entering the combustion chambers determines the running condition of the engine 12. More air raises the total power output of the engine, and thus, tends to generate higher revolutions per minute (rpm) when operated under normal watercraft operating conditions.

With reference to FIG. 7, the air inlet port 104 introduces air into the plenum chamber 88. In the illustrated embodiment, a filter assembly 116 surrounds the inlet port 104. The filter assembly 116 comprises an upper plate 118, a lower plate 120 and a filter element 122 interposed between the upper and lower plates 118, 120. Preferably, the filter element 122 comprises oil resistant and water-repellent elements. The filter assembly 116, including the lower plate 120, has a generally rectangular shape in plan aspect. The filter element 122 extends along a periphery of the rectangular shape so as to define a gap between a peripheral edge of the filter element 122 and an inner wall of the air intake box 86.

The lower plate 120 includes a duct 124, which extends inwardly toward the plenum chamber 88. The duct 124 is positioned generally above the cylinder head 68. In the illustrated embodiment, an upper end of the duct 124 slants toward the throttle bodies 108. This orientation creates a smooth flow of air through the plenum chamber 88. Those of skill in the art will appreciate, however, that the ducts 124 may slant away from the throttle bodies 108. This orientation advantageously draws water or water mist, if any, away from the throttle bodies 108. Alternatively, the upper ends of the ducts 124 may be arranged so that some slant away from the throttle bodies 108 and the rest slant toward the throttle bodies 108.

In the illustrated embodiment, a guide member 126 is affixed to the lower plate 120 immediately below the duct 124. The guide member 126 defines a recess 128 that opens toward the starboard side of the watercraft 10. Air traveling from the engine compartment 20 into the plenum chamber 88 thus travels through the recess 128 of the guide member 126. The duct 124 opens to an interior volume 130 defined by the filter element 122. The air in this volume 130 must pass through the filter element 122 in order to reach the throttle bodies 108. The filter element 122 removes foreign substances from the air as the air passes.

Because the air inlet openings 104 are formed at the bottom of the intake box 86, water and/or other foreign substances are unlikely to enter the plenum chamber 88. The filter element 122 provides a further barrier to the entry of water and foreign particles into the throttle bodies 108. In addition, part of the openings 104 are defined by the ducts 124 extending into the plenum chamber 88. Thus, a desirable length for efficient silencing of intake noise is accommodated within the plenum chamber 88.

The engine 12 also includes a fuel supply system as illustrated in FIGS. 1, 3, 6 and 7. The fuel supply system includes the fuel tank 42 (FIG. 1) and fuel injectors 132 that are affixed to a fuel rail 134 (FIG. 6) and are mounted on the throttle bodies 108. Each fuel injector 132 has an injection nozzle directed toward an intake port 82. The fuel rail 134 extends generally horizontally in the longitudinal direction. A fuel inlet port 136 (FIG. 7) passes through a side wall of the lower chamber member 92 and couples the fuel rail 134 with an external fuel passage.

Because the throttle bodies 108 are disposed within the plenum chamber 88, the fuel injectors 132 are also desirably positioned within the plenum chamber 88. However, other types of fuel injectors may be used which are not mounted in the intake box 86, such as, for example, direct fuel injectors and induction passage fuel injectors connected to the scavenge passages of two-cycle engines.

When the intake valves 84 open, air from the plenum chamber 88 is drawn through the inlet passages 109 and into the combustion chambers 70. At the same time, the fuel injectors 132 deliver a measured amount of fuel spray, which also travels through the inlet passages 109 and into the combustion chambers 70. The pistons 66 compress the air-fuel mixture within their respective cylinder bores 64, and the spark plugs ignite the compressed mixture. The resulting combustion reaction generates the power that propels the watercraft 10.

With reference to FIGS. 3–5, the engine 12 further includes an exhaust system 138 that discharges the combustion by-products, i.e., exhaust gases, from the combustion chambers 70. In the illustrated embodiment, the cylinder head 68 includes a plurality of exhaust ports 140 (FIG. 3), at least one for each combustion chamber 70. Exhaust valves 142 selectively connect and disconnect the exhaust ports 140 with the combustion chambers 70. Depending upon the configuration of the engine 12, each combustion chamber 70 may have more than one exhaust valve 142.

The exhaust system 138 further includes an exhaust manifold 144 (FIG. 4). In a presently preferred embodiment, the manifold 144 comprises a first manifold 146 and a second manifold 148 coupled with the exhaust ports 140. The first and second manifolds 146, 148 receive exhaust gases from the respective ports 140. The first manifold 146 is connected to two of the exhaust ports 140 and the second manifold 148 is connected with the two remaining exhaust ports 140. In a presently preferred embodiment, the first and second manifolds 146, 148 are configured to nest with each other.

Respective downstream ends of the first and second exhaust manifolds 146, 148 are coupled with a first unitary exhaust conduit 150. As shown in FIGS. 4 and 5, the first unitary conduit 150 further couples with a second unitary exhaust conduit 152. The second unitary conduit 152 further couples with an exhaust pipe 154 on the rear side of the engine body 78.

With reference to FIG. 5, the exhaust pipe 154 extends along a side surface of the engine body 78 on the port side of the watercraft 10. The exhaust pipe 154 connects to a forward surface of a water-lock 156. With reference to FIG. 2, a discharge pipe 158 extends from a top surface of the water-lock 156, and runs transverse to the watercraft 10 across the center plane CP. The discharge pipe 158 then extends rearwardly and opens at a stern of the lower hull section 16. Preferably, when the watercraft is in use the discharge pipe is submerged beneath a body of water on which the watercraft floats. The water-lock 156 prevents water in the discharge pipe 158 from entering the exhaust pipe 154.

With reference to FIG. 4, the engine 12 preferably includes a secondary air supply system 160 that supplies air from the air induction system to the exhaust system 138. More specifically, for example, oxygen ($O_2$) that is supplied to the exhaust system 138 from the air induction system removes hydro carbon (HC) and carbon monoxide (CO) components of the exhaust gases through an oxidation reaction.

With reference to FIG. 3, a valve cam mechanism within the engine 12 actuates the intake and exhaust valves 84, 142. The illustrated embodiment employs a double overhead camshaft drive. That is, an intake camshaft 162 actuates the intake valves 84 and an exhaust camshaft 164 separately actuates the exhaust valves 142. The intake camshaft 162 extends generally horizontally over the intake valves 84 from fore to aft generally parallel to the center plane CP, and the exhaust camshaft 164 extends generally horizontally over the exhaust valves 142 from fore to aft, also generally parallel to the center plane CP.

Both the intake and exhaust camshafts 162, 164 are journaled by the cylinder head 68 with a plurality of camshaft caps (not shown). A cylinder head cover 166 (FIG. 3) extends over the camshafts 162, 164 and the camshaft caps. The, cylinder head cover 166, which is affixed to the cylinder head 68, defines a camshaft chamber. The stays 94 and the secondary air supply device 160 are preferably affixed to the cylinder head cover 166. Additionally, the secondary air supply device 160 is preferably disposed between the air intake box 86 and the engine body 78.

The intake camshaft 162 has cam lobes 167, each associated with a respective intake valve 84. The exhaust camshaft 164 also has cam lobes 167 associated with respective exhaust valves 142. Springs (not shown) bias the intake and exhaust valves 84, 142 to close the intake and exhaust ports 82*a*, 140. When the intake and exhaust camshafts 162, 164 rotate, the cam lobes 167 push the respective valves 84, 142 to open the respective ports 82*a*, 142 by overcoming the biasing forces of the springs. The air thus enters the combustion chambers 70 when the intake valves 84 open, and the exhaust gases exit the combustion chambers 70 when the exhaust valves 142 open.

Preferably, the valve cam mechanism is configured such that the intake valves 84 begin to open just before the end of the exhaust stroke, i.e., just before the piston 66 reaches top dead center. Also preferably, the valve cam mechanism is configured such that the exhaust valves 142 close just after the end of the exhaust stroke, i.e., just after the piston 66 reaches top dead center. As such, the timing of the intake and exhaust valves 84, 142 "overlap," and thus improve performance. However, such overlap allows a small amount of exhaust gas to exit the combustion chambers 70 through the intake valves 84, particularly at low engine speeds, and thereby generate intake blow back.

The present induction system attenuates the sonic energy associated with blow back by providing a baffle 300 at the entrance to each inlet passage 109 (FIGS. 6–9B). The reduced blow back protects sensors within the engine compartment 20, such as the sensors 170, 172, 174 (FIGS. 6 and 7), from damage that is normally caused by sonic energy generated by intake blow back. Additionally, blow back produces some noise, which users can find annoying or mistake for a problem in the engine. The baffle 300 attenuates this noise.

Figure 7A:
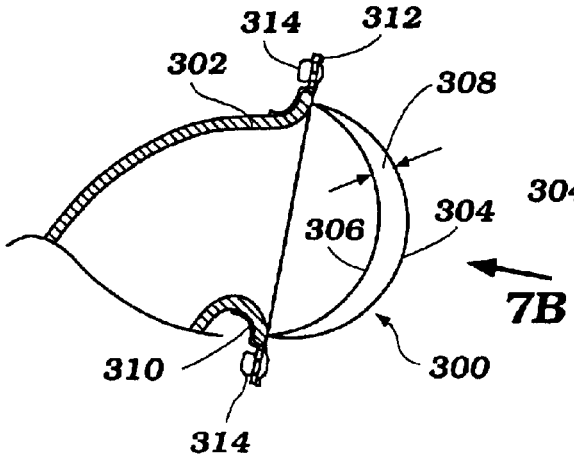
FIG. 7A is an enlarged sectional view of the inlet member and baffle shown in FIG. 7.
Figure 8:
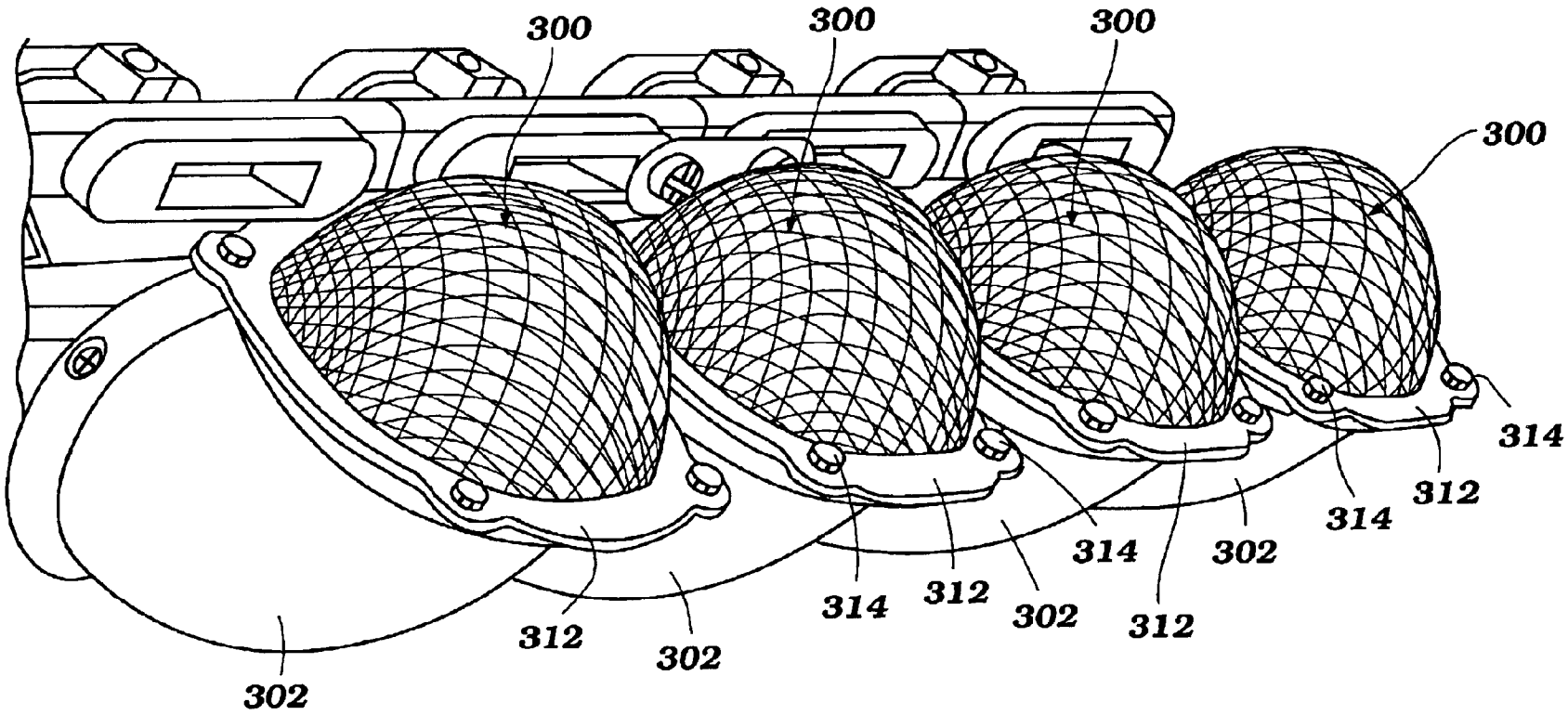
FIG. 8 is a top, front, and port side perspective view of the plurality of inlet members shown in FIG. 6.

Each throttle body 108 includes an upwardly extending tubular inlet portion 302, commonly called a "velocity stack." A baffle 300 covers a substantially circular mouth of each inlet portion 302. In the embodiment of FIGS. 6–8, the baffle 300 comprises two layers 304, 306 which are preferably made of metal or another material that is capable of withstanding the temperatures typically generated within personal watercraft engines. More specifically, as shown in FIGS. 7 and 7A, each baffle 300 comprises a convex dome having an outer layer 304 and an inner layer 306. A gap 308, indicated by the arrows in FIG. 7A, separates the outer layer 304 from the inner layer 306.

Those of skill in the art will appreciate that each baffle 300 could be shaped as a concave dome (extending into, rather than out of, each inlet portion 302), could be cone shaped, or pyramid shaped, or any other suitable geometric shape. Advantageously, however, dome shaped baffles 300 are relatively inexpensive to manufacture. Those of skill in the art will further appreciate that each baffle 300 may comprise only a single layer, or three layers, or other numbers of layers.

Each baffle layer 304, 306 includes a plurality of apertures that allow intake air to pass into the throttle bodies 108. In the embodiment of FIGS. 6–8, each baffle layer 304, 306 resembles a wire-mesh. However, the baffle layers 304, 306 could also, for example, be constructed of thin plate-like material including a plurality of drilled or punched holes. Preferably the outer baffle layer 304 has a finer mesh (more holes per unit area) than the inner baffle layer 306. In a preferred embodiment, the outer baffle layer 304 has about 20–30 holes per square centimeter, while the inner baffle layer 306 has about 20 holes per square centimeter.

Figure 7B:
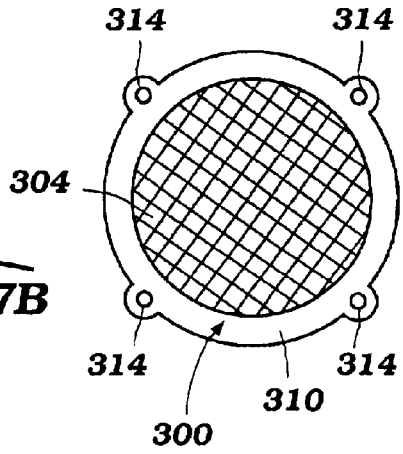
FIG. 7B is a plan view of the baffle of FIG. 7A, removed from the inlet member and as viewed along the direction of arrow 7B shown in FIG. 7A.

As shown, in FIG. 7A, a flange fitting 310 is secured around the periphery of the mouth of each inlet portion 302, and extends radially therefrom. The flange fittings 310 may be secured to the inlet portions 302 by conventional means such as welding or adhesive. Alternatively, the flange fittings 310 may comprise integral extensions of the inlet portions 302. A disk-shaped flange 312 extends from an outer edge of each baffle layer 304, 306. Each flange 312 abuts a flange fitting 310 and is secured thereto by rivets 314 (FIGS. 7A, 7B and 8) that cooperate with apertures in the flange 312 and flange fitting 310.

Those of skill in the art will appreciate that the flanges 312 may be mounted directly to the inlet portions 302 without the aid of the flange fittings 310. For example, each flange 312 could wrap around the mouth of each inlet portion 302 and be secured directly to the inside or outside of each inlet portion 302. Furthermore, although each illustrated baffle 300 is secured to an opening of each inlet portion 302, those of skill in the art will appreciate that each baffle 300 could instead be secured to an inner surface of each inlet portion 302. Alternatively, each baffle 300 could be secured within the inlet passage 109 of each throttle body 108. Alternatively, each baffle 300 could be secured to an inside surface of the upper chamber member 90 of the intake box 86, such that the baffles 300 engage the inlet portions 302, or the throttle bodies 108 if no inlet portions 302 are provided.

In the illustrated embodiment, four rivets 114 cooperate with four apertures around the periphery of each of the flanges 312 and flange fittings 310. Those of skill in the art will appreciate that each flange 312 and flange fitting 310 may include fewer or more than four apertures. Those of skill in the art will also appreciate that alternative fasteners, such as bolts and nuts, may secure each flange 312 to each flange fitting 310.

Preferably, the baffles 300 do not reduce the opening area of each air inlet port 104. Thus, the baffles 300 do not increase intake resistance. Furthermore, the baffles 300 restrict fluctuations of intake resistance at each air intake port 82*a*.

Figure 9A:
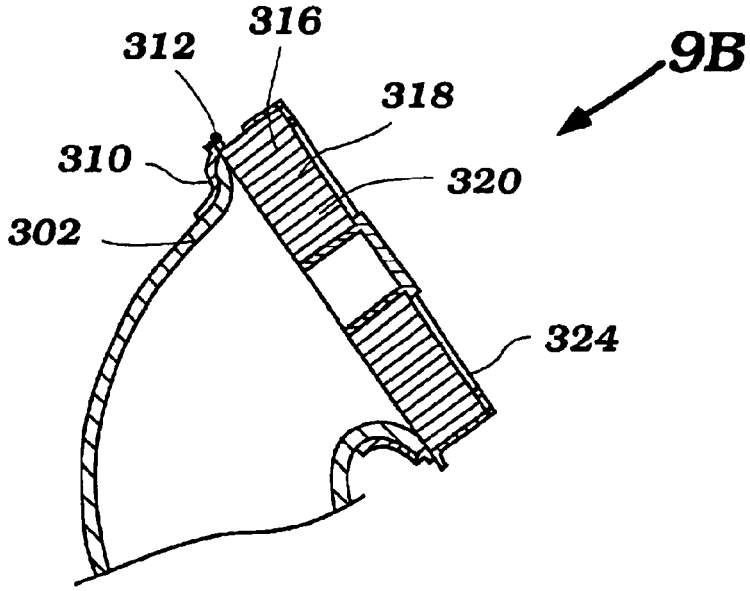
FIG. 9A is an enlarged sectional view of a modification of the inlet member and baffle shown in FIG. 7A.
Figure 9B:
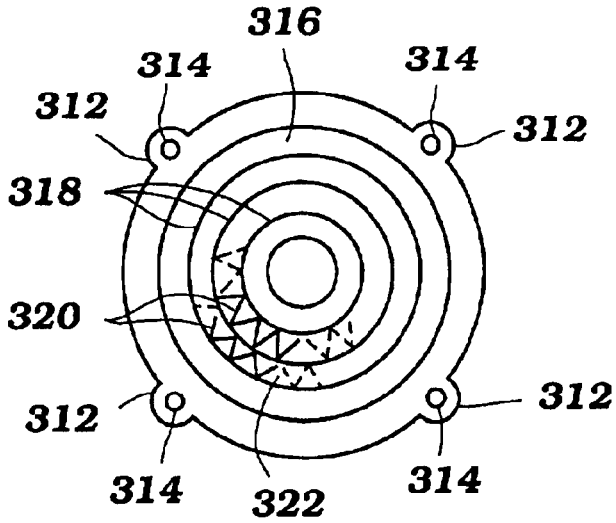
FIG. 9B is a plan view of the baffle of FIG. 9A as viewed along the direction of arrow 9B shown in FIG. 9A, with some of the baffle shown in solid line, some shown in phantom and some removed.

FIGS. 9A and 9B depict a modification of the baffle 300, referred to generally by the reference numeral 316. The baffle 316 comprises concentric wrapped ribbons 318 with intermediate layers of crimped ribbons 320. The ribbons 318, 320 are preferably constructed of thin sheet metal, such as aluminum. The ribbons 318, 320 could, however, be constructed of other suitable materials.

The crimped ribbons 320 are creased so as to form substantially triangle-shaped apertures 322 between neighboring portions of the ribbons 318. The apertures 322 enable intake air to pass through to the throttle bodies 108 and provide baffling to reduce intake blow back.

A case 324 encloses the ribbons 318, 320. A flange 312 extends from the periphery of the case 324 and is secured to the inlet member 302 in the same manner as the baffles 300 described above. In the illustrated embodiment, four rivets 314 cooperate with apertures in the flange 312 and flange fitting 310. The baffle 316 could also be attached to the inlet member 302 or throttle body 108 using any of the alternative methods of attachment described above with respect to the baffle 300.

The apertures 322 are any suitable size to reduce intake blow back. Preferably, however, a diameter of a circle inscribed within each triangular aperture is about 0.5–3 millimeters, and more preferably about 1–2 millimeters.

Preferably, the crankshaft 56 drives the intake and exhaust camshafts 162, 164. Accordingly, an end of each camshaft 162, 164, includes a driven sprocket (not shown), and an end of the crankshaft 56 includes a drive sprocket (not shown). A diameter of each driven sprocket is twice as large as a diameter of the drive sprocket. Preferably, a timing chain or belt (not shown) is wound around the drive and driven sprockets. When the crankshaft 56 rotates, the timing chain drives the drive sprocket, which drives the driven sprockets and rotates the intake and exhaust camshafts 162, 164. The rotation speeds of the camshafts 162, 164 are half of the rotation speed of the crankshaft 56, due to the ratio of the diameters of the drive and driven sprockets.

A jet pump unit 48 (FIG. 1) propels the watercraft 10. The jet pump unit 48 is mounted at least partially in a tunnel 50 formed on the underside of the lower hull section 16. The tunnel 50 is preferably isolated from the engine compartment by a bulkhead (not shown). The tunnel 50 has a downward facing inlet port (not shown) opening toward the body of water. A jet pump housing 52 is disposed within a portion of the tunnel 50 and communicates with the inlet port. An impeller (not shown) is supported within the housing 52.

An impeller shaft 54 extends forwardly from the impeller. A coupling member 58 couples the impeller shaft 54 to the crankshaft 56. The crankshaft 56 thus drives the impeller shaft 54, causing the impeller to rotate.

The rear end of the housing 52 defines a discharge nozzle 59. The discharge nozzle 59 includes a steering nozzle 60, which a rider uses to control a direction of travel of the watercraft 10. A cable (not shown) connects the steering nozzle 60 to the handle bar 32 so that the rider can pivot the nozzle 60 by rotating the handle bar 32.

When the watercraft 10 is operating, ambient air enters the internal cavity 20 defined in the hull 34 through the air ducts 46 (FIGS. 1 and 2). The air then enters the plenum chamber 88, defined by the intake box 86, through the inlet opening 104 and travels into the throttle bodies 108 (FIGS. 3 and 7). The majority of the air in the plenum chamber 88 flows to the combustion chambers 70. The throttle valves 112 in the throttle bodies 108 regulate the amount of air that passes into the combustion chambers 70. With the throttle lever 58, the rider controls the opening angles of the throttle valves 112, and thus the amount of air that flows past the valves. The air flowing past the throttle valves 112 flows into the combustion chambers 70 when the intake valves 84 open. At the same time that the intake valves open, the fuel injectors 132 spray fuel into the intake ports 82 at the direction of an electronic control unit (ECU).

The pistons 66 compress the air/fuel mixture in the combustion chambers 70, and then the spark plugs (not shown) ignite the compressed mixtures under the control of the ECU. The exhaust system 138 discharges the exhaust gases from the combustion explosions to the body of water surrounding the watercraft 10. The secondary air supply system 160 delivers a relatively small amount of air from the plenum chamber 88 to the exhaust system 138. This secondary air aids in combusting any unoxidized fuel remaining in the exhaust gases.

The force generated by the combustion explosions reciprocates the pistons 66. The reciprocating pistons 66 rotate the crankshaft 56. The rotating crankshaft 56 drives the impeller shaft 54, and the impeller rotates in the hull tunnel 50. The rotating impeller draws water into the tunnel 50 through the inlet port and discharges it rearward through the discharge nozzle 59 and through the steering nozzle 60. The rider controls the direction in which the nozzle 60 discharges water by manipulating the steering handle bar 32. The watercraft 10 thus moves according to the rider's direction.

Of course, the foregoing description is that of certain features, aspects and advantages of the present invention to which various changes and modifications may be made without departing from the spirit and scope of the present invention. Moreover, a watercraft may not feature all objects and advantages discussed above. Thus, for example, those skilled in the art will recognize that the invention may be embodied or carried out in a manner that achieves or optimizes one advantage or group of advantages as taught herein without necessarily achieving other objects or advantages as may be taught or suggested herein. The present invention, therefore, should only be defined by the appended claims.

What is claimed is:

1. A watercraft comprising a hull defining an engine compartment, an internal combustion engine disposed within the engine compartment, the engine including an engine body defining at least one combustion chamber, an air induction system including an air intake chamber having an inlet, a filter disposed in the air chamber and configured to filter the air passing into the air chamber from the inlet, at least one throttle body having an inlet end communicating with the air intake chamber, at least one intake valve configured to selectively provide fluid communication between the throttle body and the combustion chamber, and at least one baffle disposed at the inlet end of the throttle body, the baffle being configured to attenuate sonic energy associated with blow back of exhaust gases from the combustion chamber through the at least one intake valve.

2. The watercraft of claim 1, wherein the baffle comprises at least a first sheet of perforated material.

3. The watercraft of claim 2, wherein the at least a first sheet comprises approximately 20 apertures per square centimeter.

4. The watercraft of claim 2, wherein the at least a first sheet is dome-shaped.

5. The watercraft of claim 4, wherein a concave side of the at least a first sheet faces toward the throttle body.

6. The watercraft of claim 2, wherein the baffle comprises at least a second sheet of perforated material.

7. The watercraft of claim 6, wherein the at least a second sheet comprises approximately 20 to 30 apertures per square centimeter.

8. The watercraft of claim 7, wherein the first sheet comprises an inner layer, the second sheet comprises an outer layer, and at least a portion of the inner layer is separated from the outer layer by a gap.

9. The watercraft of claim 1, further comprising a tubular inlet member secured to the inlet end of the at least one throttle body.

10. The watercraft of claim 9, wherein the baffle is secured over an opening of the inlet member opposite the throttle body.

11. The watercraft of claim 1 additionally comprising a pressure sensor disposed within the air chamber.

12. The watercraft of claim 1, wherein the baffle comprises at least a first ribbon wrapped substantially in the shape of a circle, at least a second ribbon wrapped around the first ribbon, and at least a first crimped ribbon sandwiched between the first ribbon and the second ribbon.

13. The watercraft of claim 12, wherein the first crimped ribbon forms a plurality of apertures between the first ribbon and the second ribbon.

14. The watercraft of claim 13, wherein the apertures are substantially triangular.

15. The watercraft of claim 14, further comprising a substantially disk-shaped case enclosing the ribbons.

16. The watercraft of claim 15, wherein the case comprises a flange extending from an edge thereof.

17. The watercraft of claim 13, wherein a diameter of a circle inscribed within each triangular aperture is approximately 1 to 2 millimeters.

18. A watercraft comprising a hull defining an engine compartment, an internal combustion engine disposed within the engine compartment, the engine including an engine body defining at least one combustion chamber, an air induction system including an air intake chamber having an inlet, a filter disposed in the air chamber and configured to filter the air passing into the air chamber from the inlet, at least one throttle body having an inlet end communicating with the air intake chamber, at least one intake valve configured to selectively provide fluid communication between the throttle body and the combustion chamber, and means for attenuating sonic energy associated with blow back of exhaust gases passing from the combustion chamber through the at least one intake valve into the air chamber.

19. The watercraft of claim 18, wherein the inlet end of the throttle body opens to a volume of space within the air chamber, the volume of space being downstream from the filter in a direction of airflow through the induction system.

20. The watercraft of claim 18 additionally comprising a sensor disposed in the air chamber.

21. A four-cycle internal combustion engine comprising an engine body defining at least one combustion chamber, an air intake chamber, an induction passage having an inlet end disposed in an interior of the air intake chamber, the induction passage extending from the inlet end to the combustion chamber, a baffle disposed at the inlet end of the induction passage, and a sensor disposed in the air chamber.

22. The engine of claim 21, additionally comprising an air filter disposed between an inlet of the air chamber and the inlet end of the induction passage.

23. The engine of claim 21, wherein the baffle is configured to attenuate sonic energy associated with intake blow back.

24. A baffle comprising a first layer of perforated material, a second layer of perforated material overlapping the first layer, and a gap including a hollow space between the first layer and the second layer, wherein the first and second layers are each shaped as a dome.

25. The baffle of claim 24, wherein the first and second layers are each shaped as a convex dome, extending out of an entrance to an air inlet passage.

26. The baffle of claim 24, wherein no solid material is disposed in the hollow space.

* * * * *